United States Patent [19]

Iha et al.

[11] Patent Number: 4,653,565

[45] Date of Patent: Mar. 31, 1987

[54] GARAGE DOOR OPENER

[75] Inventors: Kiyoshi Iha, Elk Grove Village; Susanne Henry, Chicago, both of Ill.

[73] Assignee: Chamberlain Manufacturing Corporation, Elmhurst, Ill.

[21] Appl. No.: 758,822

[22] Filed: Jul. 25, 1985

[51] Int. Cl.[4] ..... E05F 15/16

[52] U.S. Cl. ..... 160/193

[58] Field of Search ..... 160/188, 193; 49/360, 49/139

[56] References Cited

U.S. PATENT DOCUMENTS

| | | | |
|---|---|---|---|
| 3,252,503 | 5/1966 | Jackson | 160/193 |
| 3,254,699 | 6/1966 | Wanner | 160/193 |
| 3,439,727 | 4/1969 | Perl | 160/188 |
| 4,542,383 | 9/1985 | Cusey et al. | 343/903 |

*Primary Examiner*—Ramon S. Britts

*Assistant Examiner*—Cherney S. Lieberman

[57] ABSTRACT

An improved garage door opener which has an all plastic outer case in which is mounted a metal motor supporting bracket so as to add strength and rigidity. The unit utilizes a cable drive system which moves in a vertical loop which eliminates side to side racking of the rail and which allows a less expensive rail such as a tube to be used. The all plastic housing is designed so that when the cover is removed all components are accessible and the entire operator is easily serviced, the components fit into nested areas that are molded into the plastic housing. The limit and force adjustments are conveniently located and identified on the outside of the housing. A simplified improved hanging bracket is provided wherein the hanging bracket is attached to the metal motor supporting bracket which supports the motor and the gear housing on opposite sides thereof.

6 Claims, 6 Drawing Figures

GARAGE DOOR OPENER

CROSS-REFERENCES TO RELATED APPLICATIONS

Copending application entitled "Two Drum Cable Drive Garage Door Opener" in which the inventor is Kiyoshi Iha assigned, to the assignee of the present invention Ser. No. 575,864 filed Feb. 1, 1984, now U.S. Pat. No. 4,597,528, discloses a two drum cable drive garage door opener with a substantially all metal housing which contains the garage door opener components including the motor, drive gear housing and pulleys.

BACKGROUND OF THE INVENTION

1. Field of the Invention

This invention relates in general to garage door operators and in particular to a novel garage door opener which has a substantially all plastic case which encloses the major components of the garage door opener and which can be quickly and easily installed.

2. Description of the Prior Art

Prior art garage door operators consist of sheet metal chassis to which all components and subassemblies are attached. So as to enclose the mechanism, there are generally two end panels and a U-formed sheet metal cover both of which are secured to the chassis with screws. Such units are expensive due to the amount of assembly, the amount of material, the weight and the cost of quality control. Also, it is often difficult or clumsy to install and adjust such units. The appearance of such units is generally not attractive.

SUMMARY OF THE INVENTION

The present invention provides a garage door opener which properly inter-relates mechanical function, user interface, ease of manufacturing and improved appearance. The garage door opener is a totally integrated design where all parts are interdependent. The unit is designed to accommodate a cable drive system which is a significant saving over bicycle chain driven garage door openers. It is easier to handle during installation as there are no pin connections or sprockets. The invention results in a smoother running, quieter garage door operator. The cable moves in a vertical loop as opposed to horizontal orientation for chains and does not need to mesh with gears. There is no side to side racking of the rail. Thus, a less expensive rail such as a tube can be used in place of prior art T rails. The rail may be in as many as five sections which fit together and does not require nuts and bolts to make the connections.

The trolley is connected to the cable by means of a steel catch that is crimped on the cable at the manufacturing plant. When the consumer receives the packaged garage door operator, he need merely for installation to:

1. Unravel the cable
2. Assemble the rail
3. Slip the trolley onto the rail
4. Attach the header bracket
5. Slip the cable over the pulley The use of plastic allows for an optimized design at the lowest possible cost. The all-plastic housing replaces prior art chassis such as used in prior art garage door operators. It is designed so that when the cover is removed all of the components are easily accessible and the entire operator can be easily serviced. Inside of the housing there is an organization of the components into nesting areas that are molded into the plastic. Thus, during assembly at the plant, the components may be dropped into place and secured with a pin or screw. A printed circuit board is received into a circuit board slot. Other subassemblies are eliminated and the quality control is improved. Because internal organization is optimized, the operator is smaller and lighter than those of the prior art. This results in improved handling, shipping and packaging costs as well as easier handling by the retailer and installer.

The internal organization of the unit is designed to accommodate the external user requirements. The limit adjustment and force control are easily identified on the outside front of the housing. Also, in front of the housing all of the information, bell wire terminals and the socket for the rail are located. Thus, the front surface is similar to an instrument panel and the user need not search the product to determine how and where to make adjustments or attachments. The adjustments are in the form of plastic screws that can be operated with a coin or other simple screwdriver.

The hanging bracket is very simple and the installer attaches the straps by screwing into the unit. There is a preattached nut (pem nut) in each of the two holes. Because of the simplicity of the bracket design there is greater flexibility in adapting to different ceiling configurations—including, if need be, mounting the operator flush against the ceiling.

The all plastic housing-cover design renders the unit more attractive since it can be finished in a gloss plastic.

The sheet metal motor and gear housing plate provides strength where it is most critical. A portion of this same plate extends to the outside of the unit and forms the hanging bracket. Internally tabs are bent out of this plate to prevent an installer from screwing down into the motor while hanging the unit. Also, the strain relief for the line cord is supplied to a tab inside of the unit so as to maintain a clean appearance for the housing.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
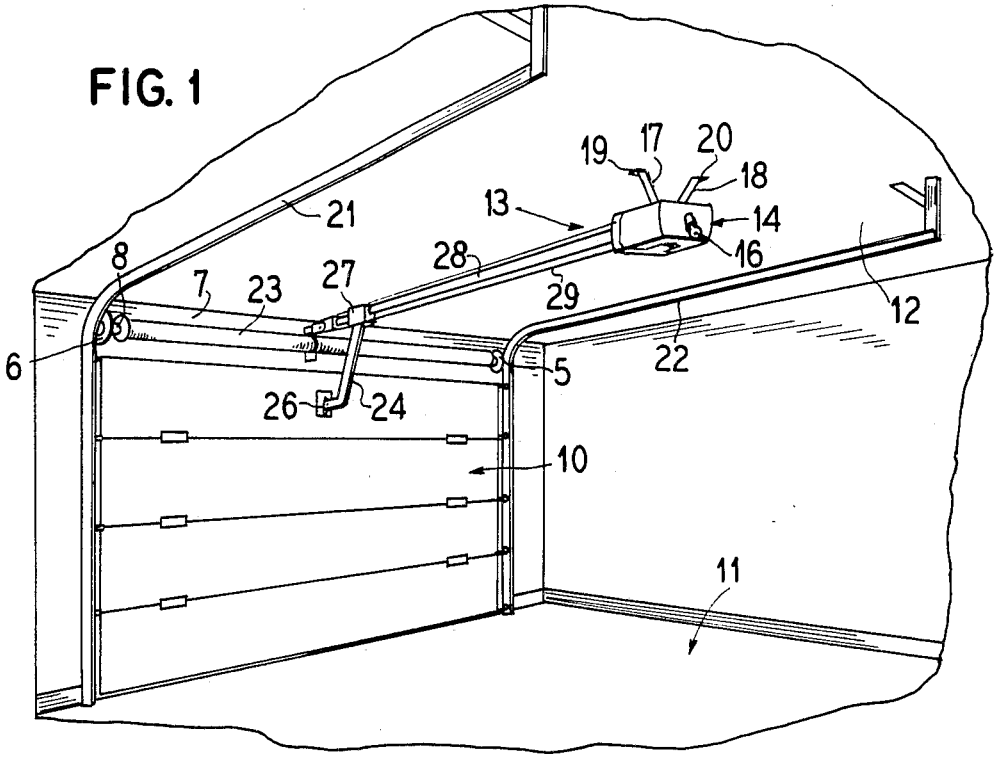
FIG. 1 illustrates the garage door operator of the invention installed so as to operate a door.
Figure 1:
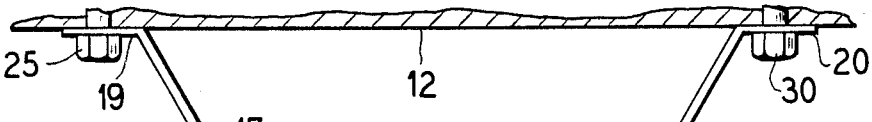
Figure 4:
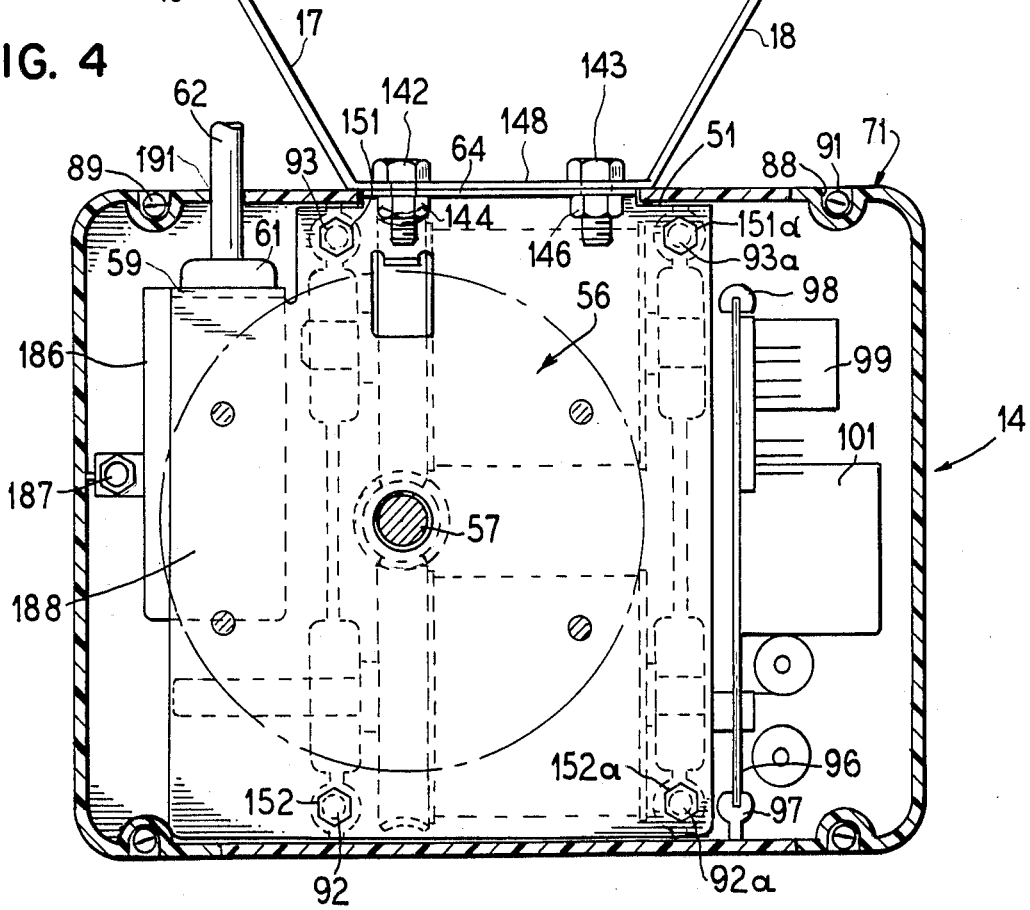
FIG. 4 is a front sectional view of the garage door operator taken on line IV—IV of FIG. 2.

FIG. 1 illustrates a garage door operator 13 of the invention mounted on the ceiling 12 of a garage and with a garage door 10 movably mounted on rails 21 and 22. A shaft 8 is rotatably mounted above the door 10 on the wall 7 and carries counter balance spring 23. Cables and pulleys such as the pulleys 5 and 6 are attached to the shaft 8 and the cables are connected to the door so as to spring bias it to counter balance the weight of the door in a conventional manner. The garage door operator 13 is attached to the ceiling 12 by bracket arms 17 and 18 which have portions 19 and 20 through which openings are formed so that lag bolts 25 and 30 can attach the door operator to the ceiling 12 as illustrated in FIG. 4 for example.

Figures 2, 3:
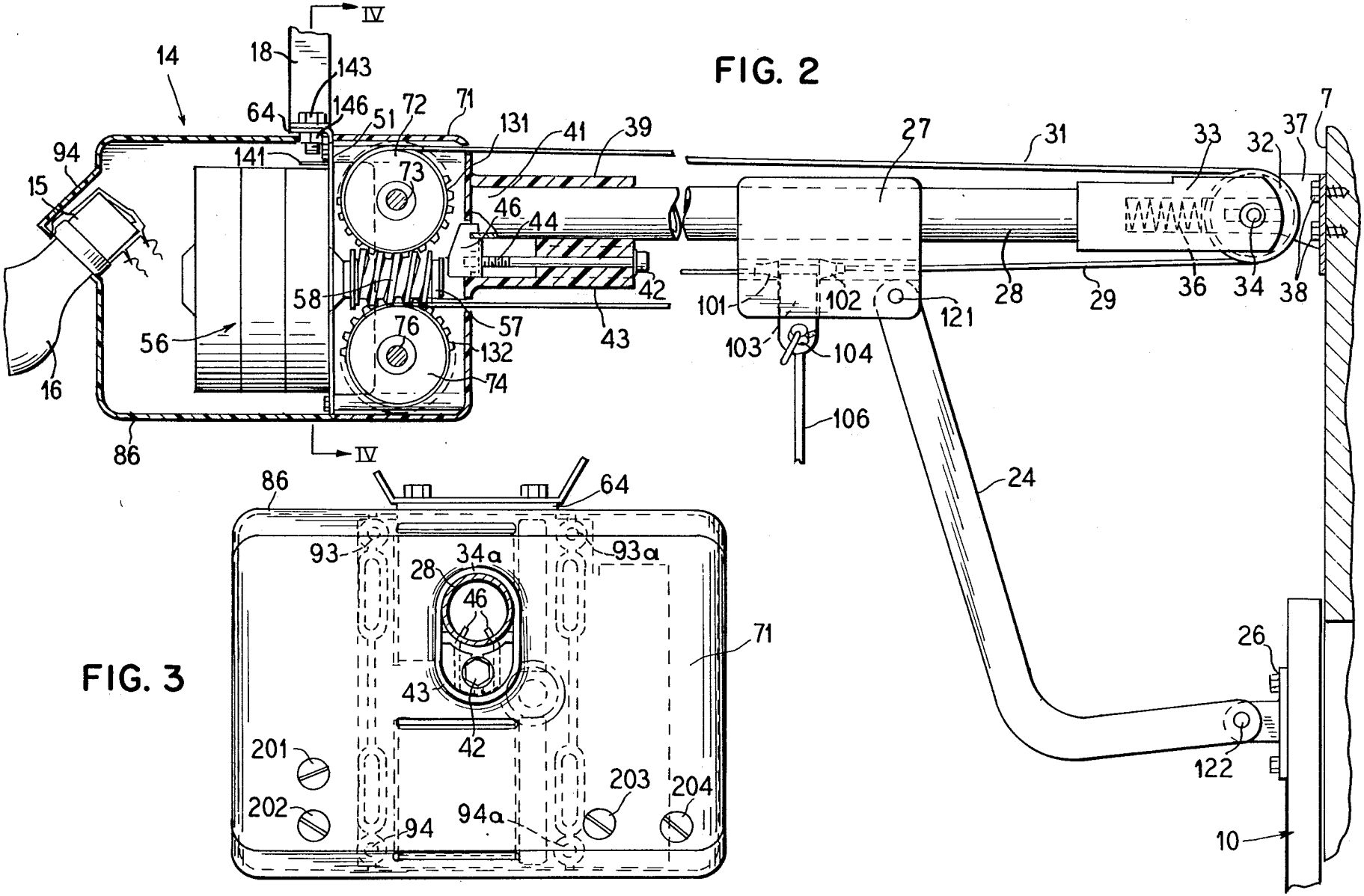
FIG. 2 is a partially cut-away side view of the garage door operator.
FIG. 3 is a front plan view of the garage door operator.

The garage door operator has a main body portion 14 which has a light 16 and the motor, gear train and various electrical components are contained in the body compartment 14. A rail 28 extends from the body portion 14 and may be formed in a number of tubular sections which telescope together. A trolley 27 fits over the tubular rail 28 as shown in FIG. 1 and FIG. 2 and has an arm 24 of generally L-shape which is attached by a pivot pin 121 to the trolley. The other end of the arm 24 is attached by a pivot pin 122 to a bracket 26 connected to the door 10 such that as the trolley 27 is moved relative to the rail 28, the door can be opened and closed. A cable 29 has a first portion which is detachably connected to the trolley 27 by means of a spring biased dog 103 which fits in a groove between stops 101 and 102 attached to the cable 29. A pull rope 106 passes through an opening in the latching dog 103 such that when the rope is pulled down the latch 103 will move out of engagement with the stops 101 and 102 so that the trolley is released from the cable 29 to allow the door to be manually opened under emergency conditions.

A pulley supporting bracket 33 is formed with a circular opening into which the end of the tubular rail 28 is received and a pulley 32 is rotatably supported by a pivot pin 34 from the bracket 33. The pivot pin 34 is spring biased by a spring 36 to the right relative to FIG. 2 and the bracket 33 is attached to the head wall 7 above the door by lag screws 38 as shown. The cable 29 passes over the pulley 32 and has a portion 31 which passes back to the garage door operator case 14.

The left end 41 of the tubular rail 28 fits into a bracket 43 which has a cylindrical-shaped extension 39 which has an opening therefore and which is attached to the front portion 71 of the garage door operator control unit 14 and the rail 28 can be adjusted longitudinally relative to the unit 14 by means of a J-shaped member 46 which has a pair of hook arms as illustrated in FIGS. 3 and 2 and which can be adjusted by a bolt 44 which threadedly engages the bracket 43. The bolt 44 has a head 42 which can be rotated so as to move the bracket 46 to the right or left relative to FIG. 2 to allow the length of the tubular rail 28 to be adjusted. The oval-shaped housing 43 joins the tubular portion 39 as illustrated in FIG. 3 and supports the bolt 44.

The cable 29 passes into the housing 14 below the extension 39 and bracket 43 and is wound about a reel 74 carried on a shaft 76. The upper portion 31 of the cable passes through an opening formed in the housing 14 and is wound about a reel 72 which is rotatably supported on a shaft 73. The reel 74 is attached to a gear 132 and the reel 72 is attached to a gear 131. The gears 131 and 132 mesh with a worm 58 mounted on a shaft 57 which extends through a metal plate 51 which supports a motor 56 and a suitable gear train.

The motor 56 and the gear train are non-rotatably attached to the metal plate 51. The metal plate 51 has an extending protector portion 141 as shown in FIG. 2 which prevents the bolts 142 and 143 from engaging the motor 56 when they are mounted through the portion 148 of the hangar bracket arms 17 and 18. The bolts 142 and 143 are threadedly received in nuts 144 and 146 connected to the case 14 for mounting the garage door operator to the ceiling 12 as shown in FIG. 4.

Figure 6:
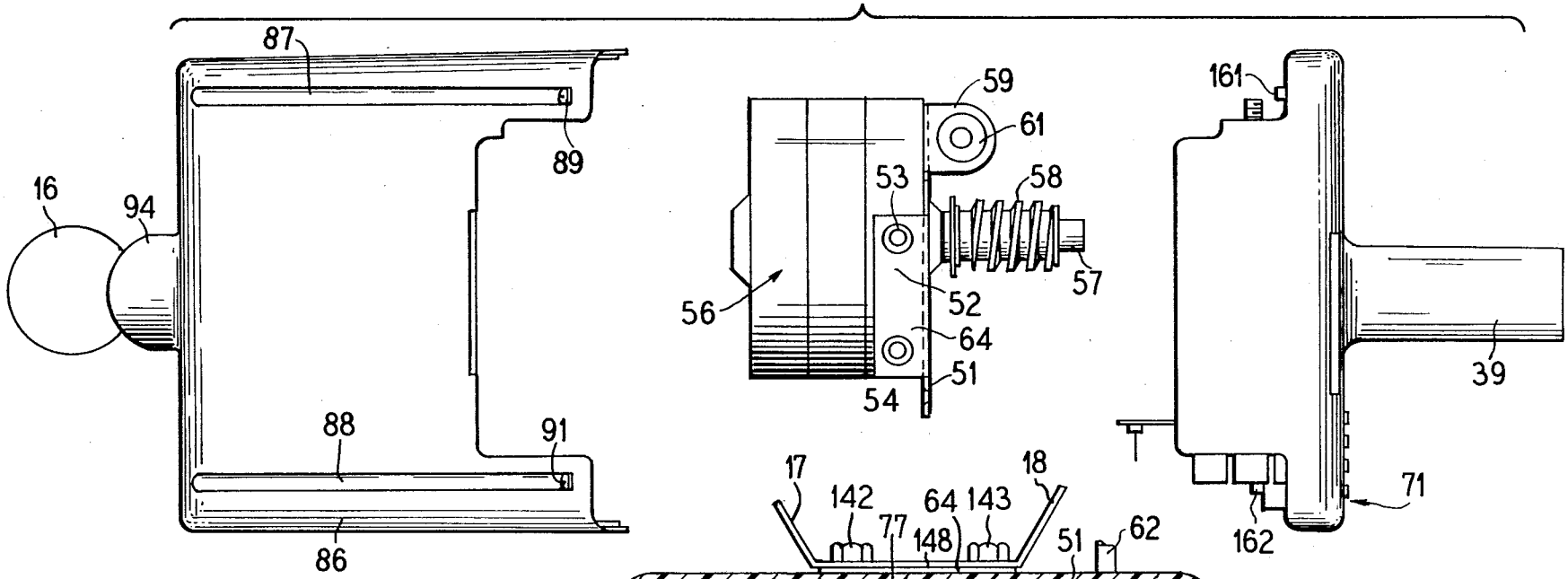
FIG. 6 is an exploded top view of the invention.

As best shown in FIG. 6, the metal mounting plate 51 to which the motor and gear train 56 are attached, is supported between a front plastic unit 71 and a rear plastic unit 86. The front plastic unit 71 is formed with four internally threaded openings 93, **93*a*, 92 and 92*a* into which bolts 151, 151*a*, 152 and 152*a* which extend through openings formed in the metal plate 51 and into the openings 93, 93*a*, 92 and 92*a* to lock the metal plate tl to the front portion 71**.

A rear plastic cover portion 86 mates with the front portion 71 and encloses the motor 56 and the metal plate 51 except for the hangar bracket portion 64. The rear portion 86 is connected to the front portion by bolts 89 and 91 which are received in threaded portions 161 and 162 in member 71. FIG. 6 illustrates bolts 89 and 91 which attach the top portion of member 86 to the top portion of member 71. There are also two bolts on the lower portion of member 86 which are received in mating threaded openings in the member 71 to attach the lower portion of the member 86 to the lower portion of the member 71.

A power cord 62 extends through an opening 191 formed between the cover members 86 and 71 and through a grommet 61 mounted in an opening of an extension 59 of the metal plate 51. The electric cord 62 supplies electrical power to the motor 56 as well as to the electronic components including the receiver 101 which is mounted in the unit 14.

The garage door operator 13 of the present invention includes all of the electrical and electronic components in the head unit 14. For example, a printed circuit board 96 is mounted between printed circuit board holders 97 and 98 as shown in FIG. 4 and the receiver 101 is mounted thereon. Other electrical components, by way of example, component 99 is also mounted on the circuit board 96. Electrical power from the power cord 62 is also supplied to the circuit board 96 and the receiver 101 and other components. A capacitor retainer 186 is connected by bolt 187 to the member 71 and carries a capacitor 188.

The electrical schematic of garage door operators are well known to those skilled in the art and is not disclosed in detail in the present application. FIG. 10 of related application Ser. No. 575,864 filed Feb. 1, 1984 assigned to the assignee of the present invention discloses an electrical schematic for a garage door operator and such disclosure is incorporated by reference in the present application.

The use of the plastic cover members 71 and 86 allows an attractive and strong and inexpensive head unit 14 to be constructed since it can be made out of glossy plastic and the various components can be mounted in compartments formed in the plastic portion, primarily the front portion 71 wherein such compartments are molded into the plastic as the plastic is molded. The metal plate 51 provides the desired mechanical strength for the motor 56 and gear train and the driven portion including the worm 58 and also provides the mounting bracket 64 which supports the garage door operator from the ceiling 12. Thus, the metal plate 51 provides mechanical strength and rigidity to the unit. The protective tab 141 illustrated in FIG. 2 prevents the bolts 143 from extending into the motor 56 to injure it. Thus, if a bolt 143 is too long and it engages the plate 141, then a shorter bolt would be utilized to attach the garage door operator to the mounting bracket 148.

As shown in FIG. 3, the front of member 71 is provided with a pair of force adjusting screws 201, 202 for adjusting the up force and down force. Two additional screws 203 and 204 are provided and extend through the front member 71 so as to set the up and down limits of the garage door opener.

Figure 5:
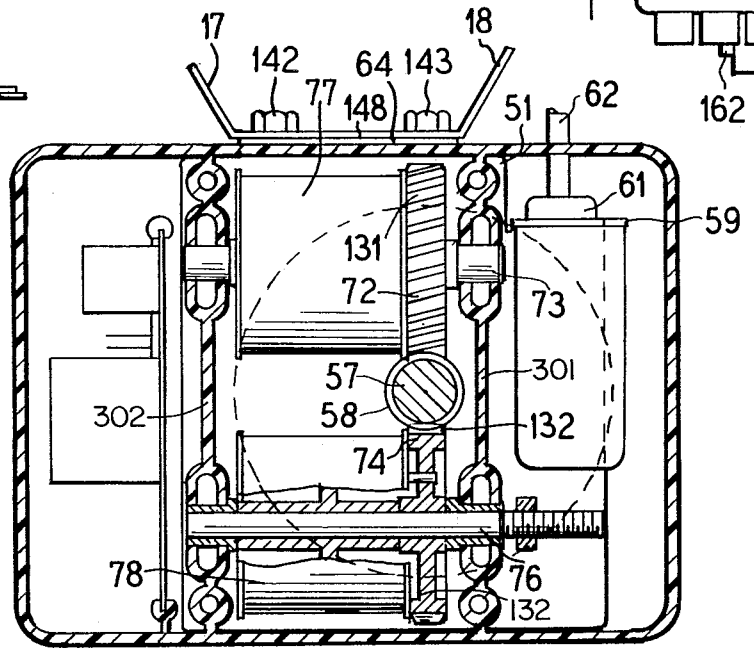
FIG. 5 is a front sectional view through the invention.

The pulleys 72 and 74 with their supporting shafts 73 and 76 are supported by plastic member 71 as shown in FIGS. 2 and 5. FIG. 5 shows plastic plates 301 and 302 in which shafts 73 and 76 are rotatably supported. The shaft 73 nonrotatably carries pulley 72 and gear 131 and shaft 76 nonrotatably carries pulley 74 and gear 132.

Although the invention has been described with respect to preferred embodiments, it is not to be so limited as changes and modifications can be made which are within the full intended scope of the invention as defined by the appended claims.

We claim:

1. A garage door opener for a door comprising a housing unit, a radio receiver mounted in said housing unit, a rail with one end attached to one side of said housing, a trolley carried on said rail and coupled to said door, a motor means mounted in said housing, first and second pulleys rotatably mounted in said housing and driven by said motor means, a third pulley rotatably supported on the second end of said rail, a cable extending from said first pulley to said third pulley and then to said second pulley, said trolley attached to said cable, said housing comprising first and second mating plastic hollow members attached together, a substantially planar metal plate attached to said first and second mating plastic hollow members and mounted therebetween, and said motor means non rotatably attached to said metal plate wherein said metal plate has a mounting bracket, and mounting means connected to said mounting bracket for supporting said garage door opener.

2. A garage door opener according to claim 1 wherein said mounting means is formed with at least one opening and a bolt extends through said opening in said mounting means, said mounting bracket formed with a threaded opening and said bolt receivable into said threaded opening to lock said mounting means to said mounting bracket.

3. A garage door opener according to claim 2 wherein said mounting means includes a pair of support arms.

4. A garage door opener according to claim 2 wherein said mounting bracket extends outside said housing.

5. A garage door opener according to claim 2 wherein said metal plate has a protecting member which is mounted adjacent said threaded opening in said mounting bracket so as to prevent the end of said bolt from engaging and injuring said motor means.

6. A garage door opener according to claim 2 including a power cord support attached to said metal plate and formed with an opening through which a power cord extends to supply power to said motor and said radio receiver.

* * * * *